United States Patent [19]

Smith

[11] Patent Number: 4,802,293

[45] Date of Patent: Feb. 7, 1989

[54] ADJUSTABLE EARTH-MOVING ATTACHMENT FOR A VEHICLE

[76] Inventor: Raymond H. Smith, Rte.2, 5AAA, Larned, Kans. 67550

[21] Appl. No.: 123,608

[22] Filed: Nov. 20, 1987

[51] Int. Cl.[4] ..... E02F 5/00

[52] U.S. Cl. ..... 37/108 R; 37/268; 37/269; 37/273; 37/274; 37/271; 172/787; 172/799.5

[58] Field of Search ..... 37/108 R, 108 A, 110, 37/268, 269, 273, 274, 276, 285, 287, 219, 221; 172/786, 787, 799.5, 155, 169, 188, 191, 201

[56] References Cited

U.S. PATENT DOCUMENTS

| | | | |
|---|---|---|---|
| 561,988 | 6/1896 | Harmon . | |
| 746,547 | 12/1903 | Miller . | |
| 803,821 | 11/1905 | Grimes | 37/269 |
| 871,976 | 11/1907 | Whitney . | |
| 964,159 | 7/1910 | Grimes | 37/269 |
| 1,266,532 | 5/1918 | Mitchell | 172/786 |
| 1,329,543 | 2/1920 | Northon | 172/787 |
| 1,331,382 | 2/1920 | Rolland . | |
| 1,354,264 | 9/1920 | Miller | 172/786 |
| 1,537,091 | 5/1925 | Snyder et al. | 37/108 R |
| 1,540,161 | 6/1925 | Callison et al. . | |
| 1,557,035 | 10/1925 | Dost . | |
| 1,575,814 | 3/1926 | Burson | 172/786 X |
| 1,719,886 | 7/1929 | Homan | 37/281 |
| 2,615,264 | 10/1952 | Satterthwaite . | |
| 2,644,252 | 7/1953 | Brown . | |
| 2,749,631 | 6/1956 | Thompson . | |
| 2,806,305 | 9/1957 | Ulrich . | |
| 2,876,852 | 3/1959 | Kenney . | |
| 3,039,209 | 6/1962 | Cron et al. . | |
| 3,195,249 | 7/1965 | Collins | 772/786 |
| 3,352,036 | 11/1967 | Miller . | |
| 3,424,251 | 1/1969 | Bouley . | |
| 3,435,546 | 4/1969 | Iverson . | |
| 3,471,953 | 10/1969 | Wyatt . | |
| 3,772,804 | 11/1973 | Bomeke . | |
| 3,841,006 | 10/1974 | Mironov et al. . | |
| 4,215,495 | 8/1980 | Wagner . | |
| 7,734,293 | 2/1956 | Barnes | 172/799.5 |

*Primary Examiner*—Eugene H. Eickholt
*Attorney, Agent, or Firm*—Litman McMahon & Brown

[57] ABSTRACT

An earth-moving attachment for use with a vehicle includes a pair of earth-moving blade assemblies mounted on a main beam. The earth-moving blade assemblies are adapted to be independently movable in several planes with respect to each other and with respect to the main beam so that a plurality of earth-working operations can be performed, and the attachment is amenable for use in conjunction with a wide variety of terrains. The blade assemblies are mounted and designed to efficiently transfer forces with the main beam.

27 Claims, 3 Drawing Sheets

ADJUSTABLE EARTH-MOVING ATTACHMENT FOR A VEHICLE

BACKGROUND OF THE INVENTION

1. Field of the Invention

The present invention relates, in general, to the field of earth moving, and, in particular, to an earth-moving attachment for a vehicle.

2. Description of the Prior Art

In the field of earth moving, most jobs require specific equipment. For example, the formation of long trenches may require the use of a backhoe; whereas, backfilling may require a bulldozer. This specificity of requirements may make one article of earth-moving equipment so impractical for use in other areas of earth moving as to be nearly unusable except in the particular area for which it is designed. Accordingly, anyone who is required to perform a multiplicity of earth-moving jobs may be required to have access to a large variety of earth-moving equipment. Such a requirement may be quite expensive. Such a requirement may also prohibit a homeowner from performing certain tasks himself, and require him to employ an expensive company to carry out such tasks as landscaping or the like.

However, more serious than simply preventing a homeowner from performing certain tasks, is the drawback of preventing a single company from performing all tasks incident to a single larger job.

For example, in the roadbuilding art, graders are used for fine-grading relatively loose and level earth, and include a leveling blade mounted between the front and rear wheels of a vehicle. Graders are usually large and expensive as they must work large areas. Even though there are many designs intended to make graders more maneuverable with respect to such operations, graders may still not be maneuverable enough to be efficiently and practically applied to other jobs such as terracing or landscaping which might require intricate turns or other such close work.

Furthermore, most graders are large vehicles, and thus, efficient use of forces applied to the earth-moving blades may not be a serious problem, and since the blades of a grader are generally not changed, the ease with which a blade mounting can be changed may not be a primary consideration in the design of graders.

Still further, since the earth-moving blade of a grader is mounted between the front and rear wheels of the vehicle, the design of graders generally does not give primary consideration to whether or not the blades and the mounting therefor are being pushed or pulled.

As discussed above, many earth-moving jobs require an earth-moving blade to be moved along a path having intricate and tight turns and to work in a small area. Accordingly, the blade must be pushed in some locations, and pulled in others if the equipment is to be operated in an efficient manner. Still further, if the earth-moving equipment is to operate efficiently, the angle of attack between the earth-moving blade and the earth should be variable so the blade position can be altered to make most efficient use of the forces exerted by the vehicle which may be in a location relative to the blades dictated by the slope and contour of the terrain worked rather than in a position selected to most efficiently apply force to the blades.

All of the above-discussed drawbacks may prevent a grader from being used to efficiently work earth in many operations, such as excavating a trench adjacent to a road during preparation of that road, that are associated with road building, which is the primary function of a grader, as well as being applied to other areas, such as the preparation of terraces or tiered banks.

Accordingly, there are other forms of earth-moving equipment, such as plows, or the like, which are generally used to perform tasks requiring a high degree of maneuverability, such as cutting, turning and pulverizing soil in the preparation of furrows and various layers of earth elevations. Such devices are maneuverable, and can have the earth-moving blades easily changed and the angle of attack easily altered. Accordingly, earth-moving equipment such a plow, does not have the above-mentioned drawbacks associated with the lack of maneuverability of large equipment.

However, equipment, such as a plow, is generally not designed to permit the earth-moving blades to operate efficiently in several modes, nor are these blades generally designed to make the most efficient use of the forces applied thereto. Still further, equipment such as a plow, has sacrified its ability to efficiently perform jobs associated with graders and the like in order to efficiently perform other jobs. Accordingly, the problem of specificity is still present, albeit in a different form.

Neither graders nor plows are capable of efficiently pushing material in the manner of a bulldozer. Since many common jobs require the use of a bulldozer, a company or a homeowner may be required to either own a bulldozer or to hire one. In either instance, the cost in time and money is expensive and may be wasteful. However, even further than this, a bulldozer has its own shortcomings that detract from its overall adaptability and versatility. For example, since a bulldozer generally includes a single earth-moving blade, it generally cannot form certain types of terraces or the like in the most efficient manner, and the design of a bulldozer does not need to place primary emphasis on the efficient distribution of forces to and from the blade during use or in the attachment of the blade to the vehicle in a manner that permits easy and rapid movement of the angle of attack of the blade (other than the usual movement associated with the pushing of material) or its removal and replacement.

While none of the presently available earth moving-equipment is extremely versatile, such equipment is still not sufficiently adaptable to be modified to make it more efficient in carrying out jobs for which it was not designed. For example, a grader generally does not have means for readily adapting such device to perform jobs most efficiently performed by a plow.

Therefore, not only does present earth-moving equipment have drawbacks associated with the specificity of the equipment design vis a vis the variety of requirements associated with the earth-moving industry, such equipment has a further drawback in that it is not easily modified to be usable, even in a manner that is not most efficient, to perform jobs for which it was not primarily designed.

Accordingly, there is need for a device which is versatile and can be used for a wide variety of earth-moving jobs and can be used to adapt other earth-moving equipment to perform a greater variety of earth-moving jobs.

OBJECTS OF THE INVENTION

It is a main object of the present invention to provide an earth-moving attachment for a vehicle which can be used to efficiently perform a wide variety of earth-moving jobs, including more adequately and rapidly filling trenches.

It is another object of the present invention to provide an earth-moving attachment for a vehicle that permits a variety of other earth-moving equipment to be adapted for use in jobs for which such other equipment was not primarily designed.

It is another object of the present invention to provide an earth-moving attachment which is adaptable to make the most efficient use of forces applied to the earth-moving blades.

It is another object of the present invention to provide an earth-moving attachment for a vehicle which is adaptable for use in a variety of modes.

It is another object of the present invention to provide an earth-moving attachment for a vehicle which is inexpensive and can be easily modified.

It is a specific object of the present invention to provide an earth-moving attachment for a vehicle which is amenable for use as a grader, a bulldozer or as a plow and can be used to perform jobs associated with each of these devices.

SUMMARY OF THE INVENTION

These and other objects are achieved by an earth-moving attachment which is adapted to be removably attached to a vehicle such as a truck, a car, a tractor or any other such self-propelled vehicle to be pushed or pulled by that vehicle. The attachment is designed to assume a variety of configurations and to efficiently distribute forces to earth-moving blades in any configuration.

In this manner, the earth-moving attachment embodying the present invention is amenable for use in carrying out jobs heretofore associated only with large equipment, such as graders, yet is also amenable for use in carrying out jobs heretofore associated with smaller equipment, such as plows or backhoes. Thus, the earth-moving attachment of the present invention permits a single vehicle to be used in performing jobs that require many intricate turns and close work, such as the building of terraces, or earth banks, or the like, as well as in performing jobs that require moving large amounts of earth, such as the building of long trenches, or the like.

Accordingly, the attachment of the present invention can be attached to a plow, a bulldozer or a grader to add functions of plowing, to a bulldozer, bulldozing to a plow or to a grader, and the like. For example, a trench can be formed adjacent to a roadbed being formed by a grader using the grader adapted to include the device of the present invention, or a bulldozer can be used to define narrow trenches by attaching the device of the present invention to the bulldozer, or the like.

Specifically, the earth-moving attachment of the present invention includes a main frame assembly having a main beam to which earth-moving blades are movably attached. The blades can be moved in a plurality of planes, including a plane which is upright with respect to the ground being traversed by the vehicle and a plane which is oriented along the ground being traversed by the vehicle. The blades are attached to the main beam to form a closed polygon with the main beam extending along a diagonal of that polygon so that forces exerted on and by the blades are always transferred to the main beam in an efficient manner. The main beam is connected to the vehicle in cantilever fashion by a main beam-to-vehicle attachment means that is adapted to distribute the forces exerted thereon by the main beam in an efficient manner. The main beam is also oriented to accommodate such forces in an efficient manner.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
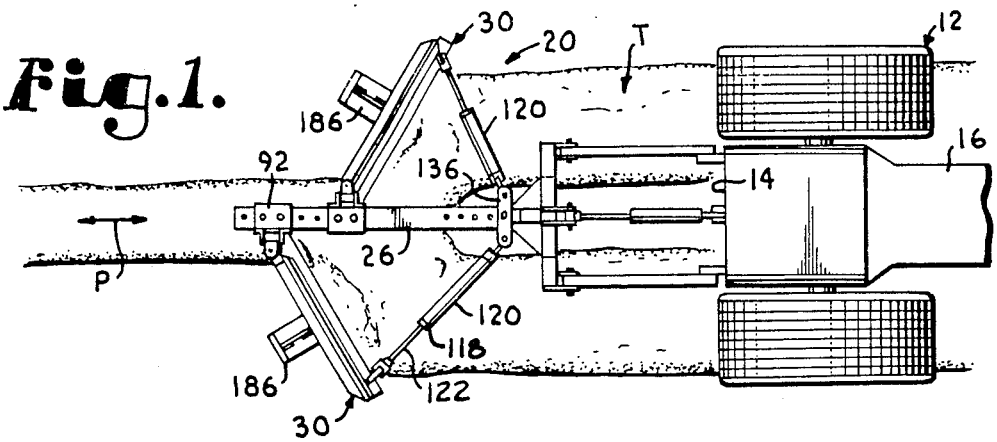
FIG. 1 is a top plan view of the earth-moving attachment embodying the present invention mounted on a self-propelled vehicle.

Shown in FIG. 1 is an earth-moving device 10 in the process of filling a trench T. The device 10 includes a self-propelled vehicle 12, such as a tractor, truck, bulldozer or the like, which is adapted to move in a forward direction or in a rearward direction along a predetermined path as indicated in FIG. 1 by the two-headed arrow P. The device is shown moving in the rearward, pushing mode in FIG. 1, but can also move in a forward, pulling mode as will be apparent from the ensuing discussion.

The vehicle 12 includes a rear end 14 and a front end 16 as well as appropriate control and motive mechanisms and the like. Those skilled in the art will be able to envision various appropriate vehicles from this disclosure, and thus the vehicle 12 will not be further described.

Figure 2:
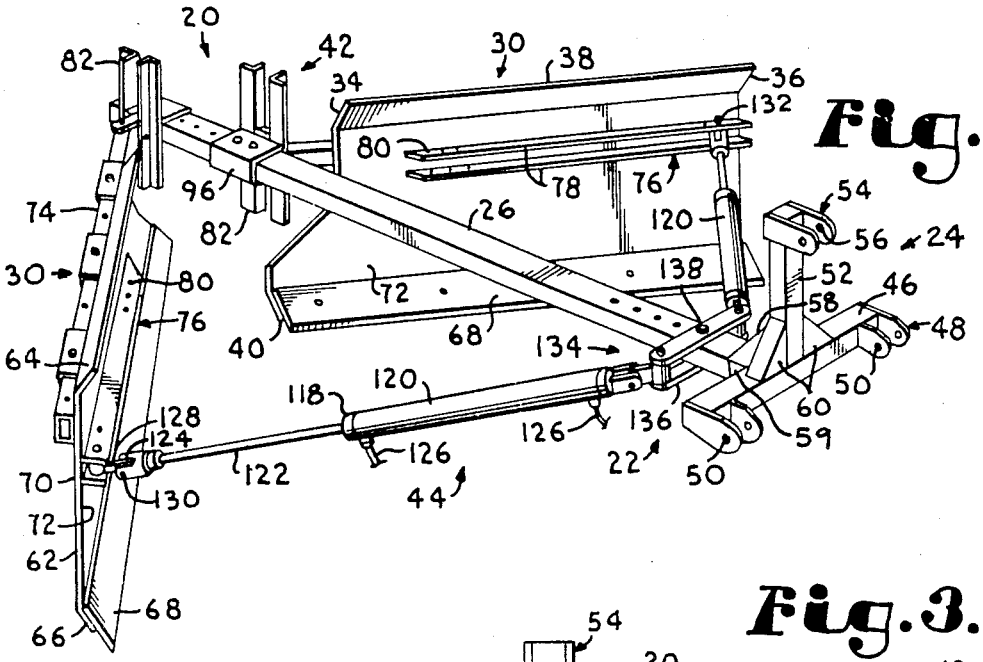
FIG. 2 is a front perspective of the earth-moving attachment of the present invention.

The device 10 includes an earth-moving attachment 20 which embodies the present invention. The earth-moving attachment 20 is best shown in FIG. 2, and attention is now directed to such FIG. 2.

The earth-moving attachment 20 includes a main frame assembly 22 having a main frame-to-vehicle attaching means 24 on one end thereof and a main beam 26 attached in cantilever fashion at one end thereof to the main frame-to-vehicle attaching means 24. The main beam 26 is mounted on the main frame-to-vehicle attaching means to have the longitudinal centerline thereof extending along the predetermined path of device movement, either forewardly or rearwardly, depending upon the direction of movement of the vehicle. In a specific application, the main beam 26 can have the longitudinal centerline thereof extending along the centerline of the path of vehicle movement.

The main beam 26 is monolithic, is designed and includes material so that it will efficiently accommodate the forces exerted thereon and transferrred thereto during operation of the device 10 in the manner described below. The beam 26 and the attachment means 24 are also designed and associated with each other and with the vehicle in a manner which efficiently transfers forces to and from the assembly 22 and to and from the main beam during operation of the device 10 in carrying out the various earth-moving operations described and taught below.

The main frame assembly 22 also includes a pair of earth-moving blade assemblies 30 which are identical, and which are each attached to the main beam 26 to be adjustable in a plurality of, and at least two, planes with respect to the path of movement of the device. The blade assemblies 30 are each individually connected to the main beam 26 to be adjustable separately from the movement and adjustment of the other blade assembly thereby making the device 10 able to carry out a wide variety of earth-moving jobs.

Each of the blade assemblies 30 includes an elongate blade 32 having an inner edge 34 locatable adjacent to the main beam 26 in the set-up configuration shown in FIG. 2, and an outer edge 36 locatable remotely from the main beam 26 in the set-up configuration of the device 10. Each blade 32 further includes a first edge 38 which is the blade top edge in the FIG. 2 set-up configuration, and a second edge 40 which is the blade bottom edge in the FIG. 2 set-up configuration. As shown in FIG. 2, each blade inner edge 34 is connected to the main beam 26 by a first blade-to-main frame attaching means 42 to be movable along the longitudinal centerline of the main beam and to be movable in a plane which is upright with respect to the ground, and can be vertical in some instances, and by a second blade-to-main frame attaching means 44 to be movable along the longitudinal centerline of the main beam 26.

As shown in FIG. 2, the blade assemblies 30 and the main beam 26 form a closed polygon which can be deformed during use and operation of the device 10 to have the sides thereof form included angles that are all different from each other, and to have the sides thereof all lie in different planes whereby the device 10 can be used in a large variety of configurations to accommodate a large variety of terrains and uses. The main beam extends along a diagonal of the polygon, and since both the inner and outer edges 34 and 36 of each blade are attached to the main beam 26, all forces applied to and by the blade assemblies are applied to and through the main beam. The main beam 26 can be shaped and sized to adequately accommodate all such forces and the cantilever connection between that main beam 26 and the main frame-to-vehicle attaching means 24 can efficiently transfer forces to and from the main beam and the vehicle 12.

The main frame-to-vehicle attaching means 24 forms a proximal end of the earth-moving attachment 20, and is shown in FIG. 2 as including an elongate cross-tongue 46 having attaching lugs 48 on each end thereof. Each attaching lug 48 includes a pair of facially opposed ears having fastener holes 50 defined therein for accommodating fasteners which pivotally connect the main frame assembly 22 to means on the vehicle. The cross-tongue 46 is coplanar with the main beam 26 in a horizontal plane and receives and transmits forces to that main beam. The coplanar arrangement of these two elements permits efficient transfer of forces therebetween.

The attaching means 24 further includes an elongate mast 52 attached to the cross-tongue 46 at a first end thereof to extend upwardly therefrom in the FIG. 2 set-up configuration. The mast 52 includes a second end remote from the first end and having a mast attachment lug 54 having facially opposing ears. The ears include aligned holes 56 which accommodate a fastener for pivotally attaching the mast to means on the vehicle.

The main frame-to-vehicle attaching means 24 includes gussets 58, 59 and 60 in the connection between the main beam 26 and the cross-tongue 46 and between the cross-tongue 46 and the mast 52 respectively. The gussets 58, 59 and 60 further reinforce the attachment means 24 and distribute forces therein.

As can be seen, the arrangement and orientation of the various elements of the main frame-to-vehicle attaching means and of the main frame assembly will accommodate and transmit forces in an efficient manner no matter what the orientation of the blade assemblies is with respect to each other, with respect to the ground and with respect to the vehicle.

Each blade 32 is monolithic and includes a planar central portion 62, a top portion 64 which is angled with respect to the central portion 62 and has the blade top edge 38 thereon, and a bottom portion 66 which is angled with respect to the central portion 62 and which is adapted to mount an appended blade 68 thereon by means of fasteners, such as bolts, or the like. Each blade 32 includes a first surface 70 facing away from the main frame-to-vehicle attaching means 24 and a second surface 72 facing the main frame-to-vehicle attaching means 24.

Each blade assembly 30 includes a blade extension beam 74 mounted on the blade first surface 70, and a blade support arm beam 76 mounted on the blade second surface. Both of the beams 74 and 76 extend along the longitudinal dimension of each blade from the outer edge 36 thereof toward the inner edge 34 thereof.

The support arm beam 76 includes a pair of facially opposed elongate elements 78 which have a multiplicity of fastener hole 80 defined therein to be aligned with each other. The purpose and function of the beams 76 and 78 will be apparent from the ensuing disclosure.

Figure 6:
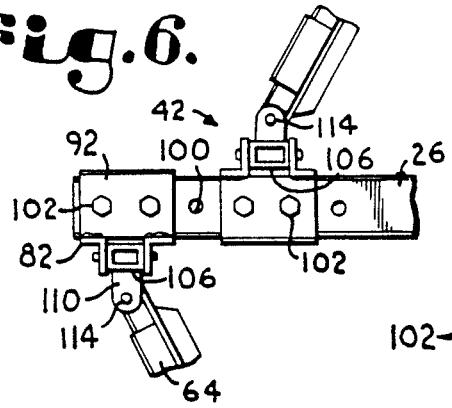
FIG. 6 is a top plan view of a first blade-to-main frame attaching means.
Figure 7:
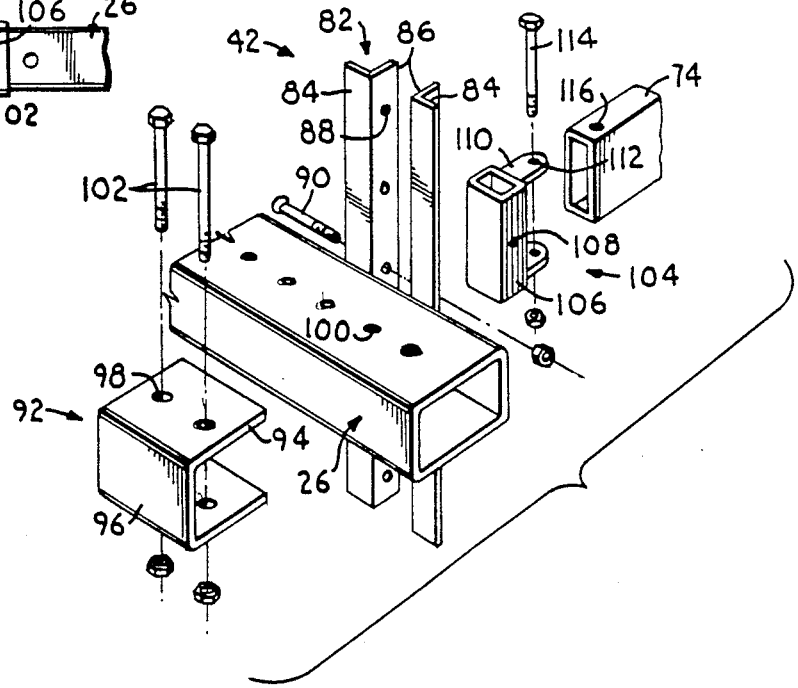
FIG. 7 is an exploded perspective view of the first blade-to-main frame attaching means.

The first blade-to-main frame attaching means 42 is best shown in FIGS. 6 and 7, and attention is now directed to such figures.

Each blade assembly 30 includes a first blade-to-main frame attaching means 42, and both are identical. Accordingly, only one such attaching means 42 will be discussed. The attaching means 42 includes a pair of elongate L-shaped bracket elements 82, each having a base 84 adapted to be mounted on the main beam 26 to be oriented transversely of the main beam longitudinal centerline, and a fastener-receiving leg 86 oriented to extend outwardly away from the main beam. The bracket elements 82 thus extend in a vertical plane in the FIG. 1 configuration of the device 10. Each of the fastener-receiving legs 86 has a multiplicity of fastener-receiving holes 88 defined therein to be in aligned relationship for receiving fasteners 90, such as bolts or the like at various positions relative to the main beam 26. The fastener-receiving legs 86 are spaced apart along the longitudinal centerline of the main beam 26.

The bracket elements 82 are connected together and are slidably mounted on the main beam 26 by a U-shaped bracket 92 having parallel legs 94 connected together by bight section 96. The legs 94 are spaced apart a distance sufficient to accommodate the main beam 26 therebetween, and include fastener-receiving holes 98 which are aligned with each other. The main beam includes fastener-receiving holes, such as hole 100, which are spaced apart along the longitudinal centerline of the main beam. The U-shaped bracket 92 is fixedly attached to the L-shaped bracket elements 82 to define a unitary slide bracket, and the slide bracket is movably attached to the main beam 26 by fasteners 102, such as bolts or the like received through the aligned holes 98 and 100 to attach the first blade-to-main frame attaching means 42 to the main beam 26 at a selected location.

The bracket 92 thus permits the first blade-to-main frame attaching means to be moved longitudinally of the main beam to adjust the position of the blade assembly associated therewith in a plane that extends along the ground, or in special cases, horizontally. The bracket elements 82 thus permit the blade assembly associated therewith to be moved in a plane that extends upright with respect to the ground, and in some special cases, vertically. The brackets 92 and 82 also permit the inner edges of each of the blades to be spaced apart from each other along the longitudinal centerline of the main beam. In such a configuration, the main beam extends along, not only the diagonal of the polygon formed by the earth-moving attachment, but along one of the sides of that polygon as well. The brackets 92 and 82 thus permit the first blade-to-main frame attaching means 42 to be used to quickly and easily adjust the position of the associated blade assembly in a plurality of planes thereby giving the overall earth-moving attachment 20 a substantial degree of versatility.

The blade associated with each attaching means 42 is attached to the bracket elements 82 by a hinge assembly 104. The hinge assembly 104 includes a tube 106 adapted to be slidably received between the L-shaped bracket elements 82, and including a fastener-receiving through hole 108 adapted to receive fastener 90 to attach the hinge assembly 104 to the bracket elements 82. The hinge assembly 104 further includes a pair of attachment ears 110 having fastener-receiving holes 112 defined therein to be aligned with each other for receiving a fastener 114, such as a hinge pin, or the like, therethrough for attaching the hinge assembly 104 to the blade extension bracket 74 via a fastener-receiving holes, such as hole 116, defined in that blade extension beam 74. The blade assembly 30 is thus attached to the L-shaped bracket elements via the hinge assembly 104 and is hence attached to the main beam to have a plurality of degrees of freedom with respect thereto in a plurality of planes.

As is best shown in FIG. 6, each blade assembly 30 is individually attached to the main beam 26 by its own separate attachment means, and thus can be moved independently of the other blade assembly. However, the forces exerted on and by the individual blade assemblies are still efficiently transferred to and from the main beam 26.

The second blade-to-main frame attachment means 44 is best shown in FIG. 2, and attention is now directed back to such Figure. The attachment means 44 includes an elongate link 118 which is lengthwise adjustable. An example of such an adjustable link is a hydraulic element which is shown in FIG. 2. The hydraulic element includes a double-acting hydraulic cylinder 120 having a rod 122 extending outwardly therefrom. The cylinder 120 operates on hydraulic pressure in the usual manner, and includes hydraulic lines 126 fluidically attaching the cylinder 120 to a hydraulic system located remotely from the blade assembly, such as on the vehicle 12, or the like.

The hydraulic cylinder is attached to the associated blade by means of a cylinder-to-blade extension beam attaching means which includes an attaching ear 124 on the cylinder rod 122 and a clevis 128 having a clevis pin 130 which attaches the attaching ear 124 to the blade support arm beam 76. The clevis 128 is attached to the beam 76 by a fastener 132, such as a bolt, which extends through the holes 80 in the beam 76. The clevis is attached to the fastener 132 to be pivotal in a plane which contains the cylinder to move toward and away from the main beam 26.

The other end of the cylinder 120 is attached to the main beam 26 by a link attaching means 134. The link attaching means 134 includes a slider 136 mounted on the main beam by a fastener 138, such as a bolt, extending through a hole in the slider and received in a hole, such as hole 140 defined in the main beam. There are a plurality of holes 140 and all are spaced apart longitudinally of the main beam so that slider 136 can be moved along the longitudinal axis of the main beam to adjust the orientation of the blade assemblies 30.

Figure 10:
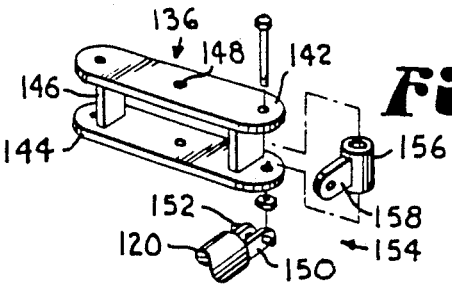
FIG. 10 is a perspective view of one element used in a second blade-to-main frame attaching means.

The slider 136 and the attaching means 134 are best shown in FIG. 10, and attention is now directed thereto. The slider 136 includes a first plate 142, which is the top plate in the FIG. 2 configuration, and a second plate 144, which is the bottom plate in the FIG. 2 configuration, connected together by side plates 146 which are spaced apart along the lengthwise dimension of the slider a distance sufficient to accommodate the main beam 26 therebetween. The slider includes a fastener-receiving hole 148 which receives the fastener 138 attaching the slider to the main beam.

Each hydraulic cylinder 120 is attached to the slider by a cylinder-to-slider attaching means which includes an attaching ear 150 having fastener-receiving holes defined therein for receiving a fastener 152, such as a hinge pin, or the like, and a clevis assembly 154 which is mounted on each of the slider side plates 146 in a pivotal attachment. The clevis assembly includes a tube 156 pivotally mounted on an associated one of the slider side plates 146 and an ear 158 having a fastener-receiving hole defined therein for receiving fastener 152 to pivotally attach the clevis assembly 154 to the cylinder attaching are 150 thereby pivotally attaching the slider 136 to the hydraulic cylinder 120 in a manner which permits the link arm 118 to move in a plane containing the main beam 26. In this manner, the link arms 118 can move toward and away from the main beam 26 to adjust the orienation of the blade assemblies 30 with respect to each other and with respect to the main beam 26.

While a hydraulic system is shown as the link 118, it can also be a mechanical link, such as a jackscrew, a lap joint, or the like without departing from the scope of the present disclosure.

Figure 3:
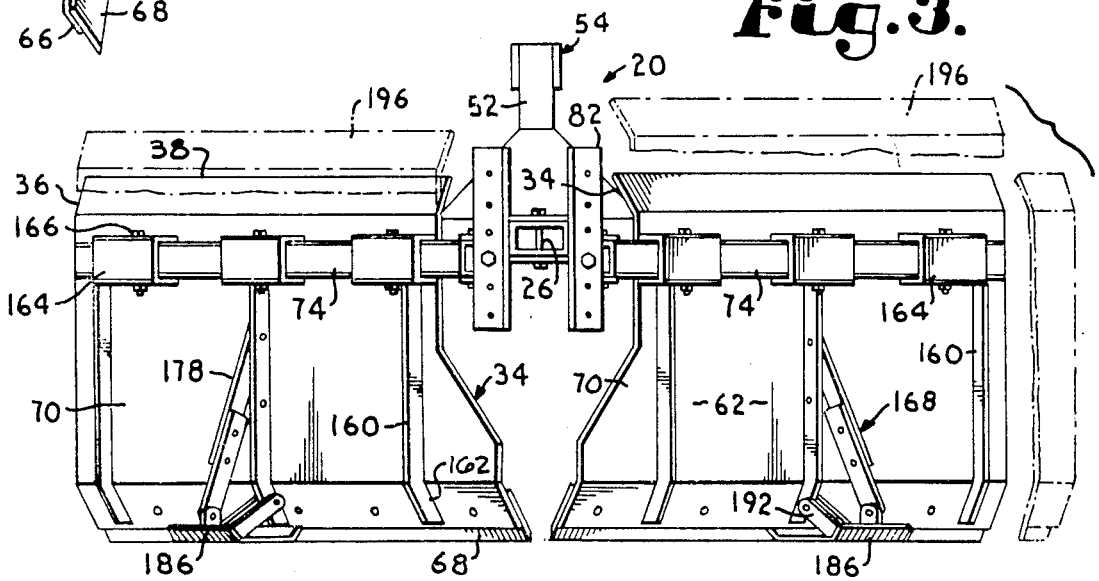
FIG. 3 is a rear elevation view of the earth-moving attachment of the present invention.
Figure 8:
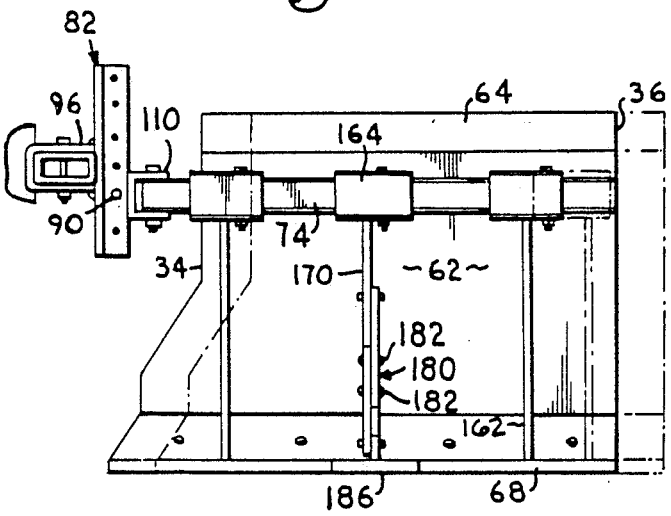
FIG. 8 is a rear elevation view taken along lines 8—8 of FIG. 4.

As shown in FIGS. 3 and 8, the blades can be supported by means such as lateral braces 160 which are mounted on the blade surface 72 and extend from the blade extension bracket 74 to the second edge 40 of the blade. The beam can also include a segment 162 supporting the appended blade 68, and the beam 74 can include brackets 164 attached to that beam 74 by fasteners 166.

The blade assemblies can also include additional implements which are attached in outrigger fashion by linkages 168. Each of the outrigger linkages includes an elongate link arm 170 mounted on the blade and extending from the beam 74 to the second edge 40 thereof, and including an extension 172 associated with the appended blade 68. Each link arm 170 has a plurality of spaced-apart holes 174 defined therein. A second link arm 176 includes a pair of arms 178 attached together by a lap joint 180 which includes a plurality of fasteners 182. One end of second link arm 176 is attached to the first link 170 by a fastener extending through the holes 174 and a hole defined in one end of the second link arm 178. The other end of the link arm 178 has a fastener-receiving hole defined therein.

Figure 9:
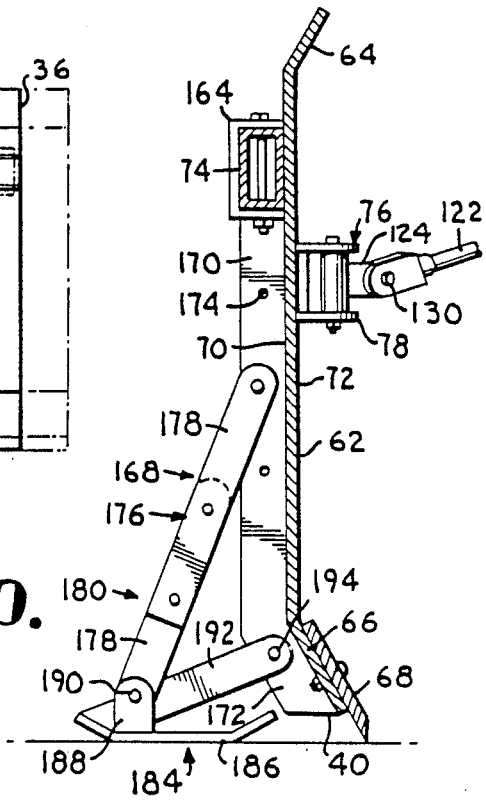
FIG. 9 is a side elevation view taken along lines 9—9 of FIG. 4.

As best shown in FIG. 9, one form of outrigger attachment includes a skid 184 having a plate 186 with an attachment ear 188 thereon with a fastener-receiving hole defined therein for receiving a fastener 190 to pivotally attach the skid 184 to the link arm 178. A further link 192 attaches another part of the skid to the brace extension 172 to attach the skid to the blade in a secure manner. A pivot pin 194 attaches the link 192 to the brace extension.

Other outrigger attachments, such as rollers, upper appended blades 196 (FIG. 3) or the like can also be used in conjunction with the blade assembly 30 if suitable. Such additional attachments increase the versatility of the device 10.

As can best be seen in FIG. 3, the inner edge 34 of each blade is sideways stepped to decline toward the main beam from the first blade edge 38. This sideways stepping permits the lower marginal portions of the blade inner edges to be located as close to each other as possible to increase earth-moving efficiency of the device, yet will define a spacing between the blade inner edges adjacent to the first blade-to-main frame attaching means 42 to permit the blade assemblies 30 to be moved using such attaching means 42 as above discussed. In this manner, the earth-moving attachment 20 can be easily adjusted, yet can also move the most earth possible.

Figure 4:
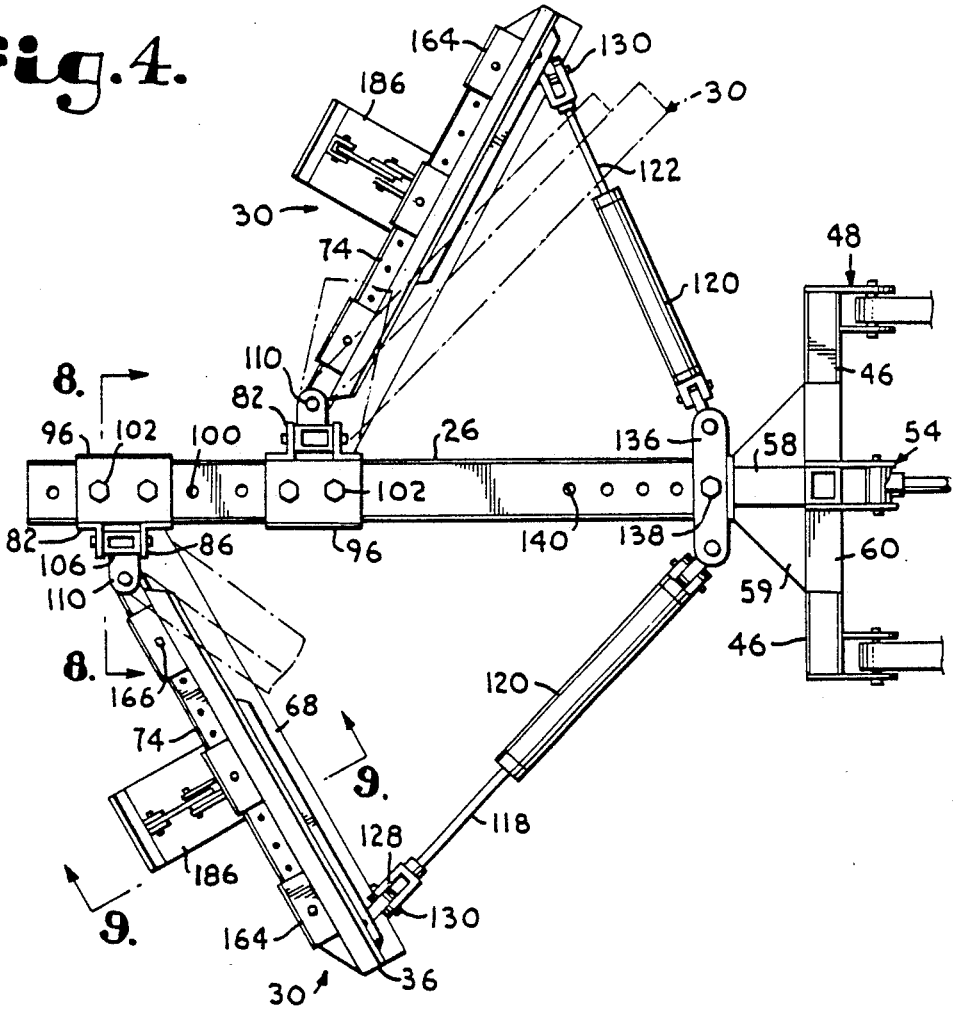
FIG. 4 is a top plan view of the earth-moving attachment of the present invention in the FIG. 3 configuration.
Figure 5:
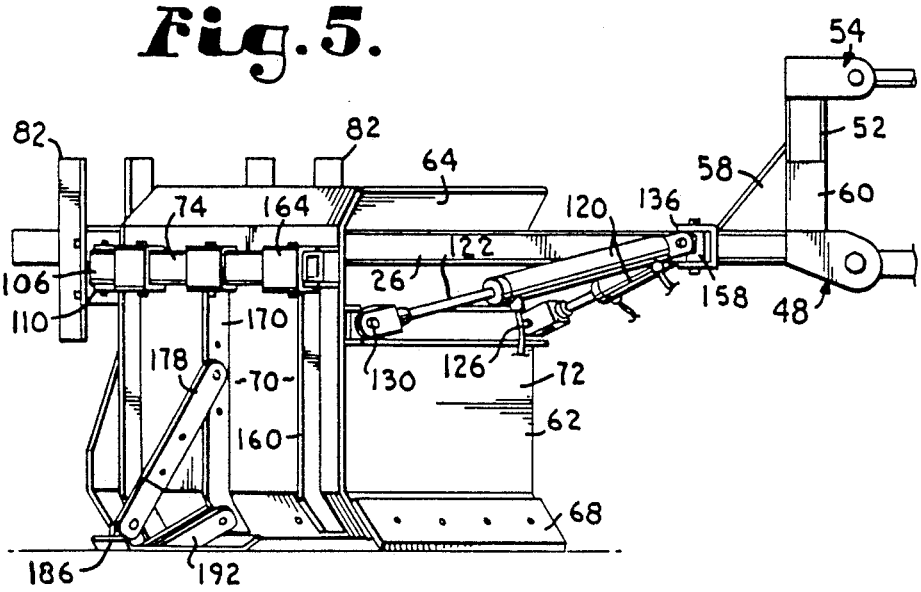
FIG. 5 is a side elevation view of the earth-moving attachment in the FIG. 3 configuration.

The operation of the device 10 should be evident to one skilled in this art from the above description. Accordingly, this operation will not be discussed in detail. It is to be noted, however, that, as indicated in FIG. 4, the blade assemblies 30 can be adjusted independently of each other to assume a variety of orientations with respect to the ground and with respect to each other using the main frame assembly 20 in the manner discussed above. For example, one of the blade assemblies can be on a higher plane than the other blade assembly, and the angular orientation of the assemblies with respect to each other can be adjusted using the main frame assembly 20 in the manner discussed above. It is noted that the angular relationship of the blade assemblies can be adjusted in two planes by means of the first and second blade-to-main frame attaching means. This permits a multi-degree of freedom adjustment of the attachment 20. It is also noted that in any of the positions of the blade assemblies, the forces exerted on and by the blades are efficiently transferred to and from the main beam and to and from the vehicle due to the relationship of the elements as discussed above.

By attaching the main beam 26 the distal end of the main beam to a vehicle, the attachment 20 can be pulled behind a vehicle. Even in such an operational mode, the forces arising in the attachment 20 are evenly distributed due to the relative orientation of the elements as discussed above.

INDUSTRIAL APPLICABILITY

In addition to the above-mentioned uses for the device 10, this device can be used in the following situations: to cover ditches with continuous movements; to construct terraces; to construct embankments for various uses; to pile and pack earth works to prevent flooding; in the manufacture of artificial waterways; to bank around railroad tracks and buildings; to produce military embankments; to form banks around trees and plants to retain water; to plant seedlings; to reform and reshape piles of material such as sand and road tar; to evenly pile material; to pile snow collected on roads, parking lots, playing fields and the like; to loosen and pile manure in pens; in mining; in surface mining; in sand and gravel pit operations; in various farm operations; in gardening operations; to clean up debris; to load industrial belts; to pile old asphalt from a road; for use in connection with an escalator to load trucks; and the like.

The blades can be moved and their positions altered to adapt the attachment 10 to the particular earth-moving job being conducted. These positions can be varied independently of each other, or can be varied in a functionally related manner as necessary to produce the desired angular relationship for a particular job. Still further, these positions of attachment can be varied to even reverse the angular relationship of the blades from proximally diverging relationship shown in FIG. 2 to a proximally converging relationship whereby the blades can be oriented to most effectively distribute forces and move earth for a particular job.

It is to be understood that while certain forms of the present invention have been illustrated and described herein, it is not intended to be limited to the specific forms or arrangement of parts described and shown.

I claim:

1. An earth-moving attachment for a vehicle comprising:

a main frame assembly which includes a main frame-to-vehicle attaching means adapted to be mounted on the vehicle, a main beam connected at one end thereof to said main frame-to-vehicle attaching means and extending outwardly therefrom to have the longitudinal centerline thereof aligned with the direction of movement of the vehicle along a path;

a pair of earth-moving blade assemblies which can be movably mounted on said main beam, each earth-moving blade assembly including a blade for moving earth in a predetermined direction with respect to the path, an inner edge on said blade locatable adjacent to said main beam, an outer edge on said blade, a first blade-to-main beam attaching means attaching said blade to said main beam, a second blade-to-main frame attaching means attaching said blade to said main beam, said first blade-to-main beam attaching means including means for adjusting the height of said blade above the path and means for adjusting the position of the inner edge of said blade with respect to said main beam longitudinal centerline, and said second blade-to-main beam attaching means including means for adjusting the position of the outer edge of said blade with respect to said main beam longitudinal centerline.

2. The earth-moving attachment defined in claim 1 wherein said first blade-to-main frame attaching means includes means to adjust the position of said blade in at least two planes.

3. The earth-moving attachment defined in claim 2 wherein said first blade-to-main frame attaching means includes means to vary the angular relationship of said blade with respect to the blade in the other earth-moving blade assembly in one plane of said at least two planes.

4. The earth-moving attachment defined in claim 3 wherein said second blade-to-main frame attaching means includes means for adjusting the angular relationship of said blade with respect to the blade in the other earth-moving blade assembly in said one plane.

5. The earth-moving attachment defined in claim 4 wherein said one plane includes a line which is parallel to the path of travel of the vehicle, and the other plane of said at least two planes is oriented at an angle with respect to said one plane.

6. The earth-moving attachment defined in claim 5 wherein said first blade-to-main frame attaching means includes means for spacing the inner edge of said blade apart from the inner edge of the blade in the other earth-moving blade assembly along the longitudinal centerline of said main beam.

7. The earth-moving attachment defined in claim 5 wherein said first blade-to-main frame attaching means height adjusting means includes a beam means mountable on said main beam and means for mounting said beam means on said main beam in a manner such that said beam means is movable along the longitudinal centerline of said main beam.

8. The earth-moving attachment defined in claim 7 wherein said bracket means includes means for moving said blade in said other plane of said at least two planes.

9. The earth-moving attachment in claim 8 further including a slider mounted on said main beam and each of said earth-moving blade assemblies further includes an adjustable means for connecting said slider to the outer edge of said blade included in said each earth-moving blade assembly.

10. The earth-moving attachment defined in claim 9 wherein said adjustable means includes a hydraulic cylinder.

11. The earth-moving attachment defined in claim 10 wherein each earth-moving blade assembly further includes a blade-support arm beam mounted on said blade for attachment to said hydraulic cylinder, and a cylinder-to-slider attaching means on said hydraulic cylinder attachable to said slider.

12. The earth-moving attachment defined in claim 11 wherein said cylinder-to-slider attaching means includes means for adjusting the angular position of said hydraulic cylinder with respect to said blade and with respect to said main beam, and each earth-moving blade assembly further includes a cylinder-to-support arm beam attaching means associated with said hydraulic cylinder and having means for adjusting the angular position of said hydraulic cylinder with respect to said blade and with respect to said main beam.

13. The earth-moving attachment defined in claim 12 wherein said hydraulic cylinder includes a rod that is extendable out of said hydraulic cylinder.

14. The earth-moving attachment defined in claim 13 wherein said main frame-to-vehicle attaching means includes a cross tongue which is oriented to extend transversely to the longitudinal centerline of said main beam.

15. The earth-moving attachment defined in claim 14 wherein said main frame-to-vehicle attaching means includes a vertical mast mounted on said cross tongue.

16. The earth-moving attachment defined in claim 15 wherein said main beam is located to extend along the central axis of the path of travel of the vehicle.

17. The earth-moving attachment defined in claim 1 wherein the inner edge of said blade is stepped.

18. The earth-moving attachment defined in claim 17 wherein said blade further includes brace means.

19. The earth-moving attachment defined in claim 18 wherein said blade further includes an appended blade.

20. The earth-moving attachment defined in claim 19 wherein said blade further includes a skid.

21. The earth-moving attachment defined in claim 20 wherein said blade further includes means attaching said skid thereto, said skid attaching means including means for varying the orientation of said skid with respect to said blade.

22. In combination:

a vehicle adapted to move along a predetermined path;

a main frame assembly which includes a main frame-to-vehicle attaching means adapted to be mounted on one end of said vehicle, and a main beam connected at one end thereof to said main frame-to-vehicle attaching means and oriented to have the longitudinal centerline thereof aligned with the predetermined path;

a pair of earth-moving blades which can be movably mounted on said main beam, each of said earth-moving blades having an inner edge and an outer edge and each of said earth-moving blades being adapted to move earth in a predetermined direction with respect to said path;

blade-to-main beam connecting means attaching said blade inner and said blade outer edges to said main beam in a manner such that said blades and said main beam form a closed polygon with each of said blades extending along one side of said polygon and said main beam extending along a diagonal of said polygon; and said blade-to-main beam attaching means including a blade position adjustment means associated with each blade for varying the orientation of each blade in at least two planes with respect to said main beam, each of said blade position adjustment means being adapted to vary the orientation of the blade associated therewith separately and independently of the other blade whereby the orientation of each blade with respect to the path can be varied in a plurality of planes.

23. The combination defined in claim 22 wherein said main beam is mounted in cantilever fashion on said main frame-to-vehicle attaching means.

24. The combination defined in claim 23 wherein the longitudinal centerline of said main beam is aligned with the longitudinal axis of the path.

25. The combination defined in claim 22 wherein a portion of said main beam extends along one side of said polygon.

26. The combination defined in claim 22 wherein all of the angles included between the sides of said polygon are different from each other.

27. The combination defined in claim 22 wherein all of the sides of said polygon lie in planes that are different from each other.

* * * * *